US005992714A

United States Patent [19]

Morgan

[11] Patent Number: 5,992,714

[45] Date of Patent: Nov. 30, 1999

[54] WIDTH ADJUSTABLE GARMENT HANGER AND JAM LOCKING CLAMP MEANS THEREFOR

[75] Inventor: Donald F. Morgan, Zeeland, Mich.

[73] Assignee: Batts, Inc., Zeeland, Mich.

[21] Appl. No.: 08/934,975

[22] Filed: Sep. 22, 1997

[51] Int. Cl.[6] ..... A47G 25/48; A47G 25/14

[52] U.S. Cl. ..... 223/96

[58] Field of Search ..... 223/85, 95, 96, 223/93, 91

[56] References Cited

U.S. PATENT DOCUMENTS

| | | | |
|---|---|---|---|
| 2,303,014 | 11/1942 | Williams | 223/96 |
| 2,573,622 | 10/1951 | Stoneburner | 223/96 |
| 2,889,092 | 6/1959 | Gibron | 223/91 |
| 3,209,966 | 10/1965 | Wach | 223/85 |
| 4,034,903 | 7/1977 | Batts | 223/96 |
| 4,826,056 | 5/1989 | Duester et al. | 223/96 |
| 4,884,727 | 12/1989 | Blanchard | 223/93 |
| 4,901,894 | 2/1990 | Blanchard | 223/96 |

*Primary Examiner*—Bibhu Mohanty
*Attorney, Agent, or Firm*—Baker & McKenzie

[57] ABSTRACT

A garment clamp assembly, and a garment hanger which includes such a clamp assembly, in which a single size of hanger can accommodate a wide range of widths of garments by the use of sliding clamp assemblies which hold the garment beneath the hanger and which can be moved, and then jammed into a fixed position, by the application of modest hand generated pressures applied to a drop bracket which is in frictional sliding contact with the garment hanger.

3 Claims, 2 Drawing Sheets

WIDTH ADJUSTABLE GARMENT HANGER AND JAM LOCKING CLAMP MEANS THEREFOR

This invention relates generally to garment hangers especially adapted for the display and storage of garments in retail outlets, and specifically to a hanger, having at least one clamp assembly to which a garment to be displayed is attached, which is capable of displaying garments of widely different widths, and a clamp assembly therefor. It is specifically directed to a clamp assembly which may be easily moved along a suspension member of the hanger by hand to accommodate different sizes and width of garments but which, with only a slight pressure application by the hand of the user, can be snugly jammed into contact with its associated suspension member so that, once a position is selected, the infinite number of relative positions of the suspension member and the clamp assembly can be maintained for as long as desired.

BACKGROUND OF THE INVENTION

Due to current and, in all probability, future competitive pressures in the garment industry it is becoming increasingly important that the number of different members in a given style of garment hanger be minimized to the greatest extent possible. This presents a significant challenge to the hanger designer because not only is it necessary that the hang width of a hanger extend over a wide distance, so as to accommodate petite women's sizes as well as large men's sizes, but the adjustment must be made quickly and, once made, must be securely maintained. Changing the width can be accomplished by the skilled designer by designing loose fits between moving parts, but this expedient becomes less and less practical as the width of the garment to be suspended from the hanger increases. In other words, as the width of a garment to be secured to the hanger by the clamp assemblies (usually two in number) increases, the greater is the tendency for the weight of the garment to pull the clamp assemblies toward one another. Should the clamp assemblies move toward one another under the weight of the garment the result will be a sag or drop of the garment with respect to the suspension member to which the clamp assemblies are secured. A sagging garment on a hanger is displeasing to the eye of a potential purchaser in that it projects an image of sloppiness which obviously does not whet the desire of a potential purchaser to buy the garment. The problem of sag can of course be at least partially counteracted by designing the components which move relative to one another—the suspension member and the clamp assembly or assemblies—with tighter clearances. However, the tighter the clearance the more difficult it is for the clamp assemblies to be moved by hand pressure relative to the suspension member, and, for personnel who must perform this task many times daily, such as clerks in retail stores, the task becomes onerous and unpleasant. When a clerk is required to work with tight clearance (i.e.: high friction) components, there is a natural human tendency to apply the minimum hand pressure to the clamp assemblies and the result, often, is that the clamps are not moved outwardly as far as they should be to properly display a wide width garment on a hanger which, moments before, was sized for a narrow width garment. By the same token, should it be required that the space between clamp assemblies must be shortened, there is a tendency to move the clamp assemblies only part way toward their proper new location which then requires a second effort or results in a garment which is displayed off-center with respect to the mid-point of the hanger, or both.

In addition to the foregoing considerations it is desirable that the concept of quick and effortless adjustability and secure locking of the clamp assembly to the suspension member be provided in garment hangers in which (1) the clamp jaws of the clamp assembly are in direct contact with the suspension member, and (2) the clamp jams are not in direct contact with the suspension member, as when the clamp assembly is deliberately located beneath the suspension member as by a vertical hang structure. It will be understood that certain garments, to be displayed to best advantage in a retail store, should be hung from the hanger's suspension member at a considerable distance beneath the suspension member. Such garments might include, for example, a skirt in which a fancy edge or ruffle extends some distance above the elastic in the waistband and hence, in order to appropriately present the upper edge to the eye of the potential purchaser, the garment should be gripped a greater distance beneath its uppermost edge than would be the case when a pair of plain top pants or shorts are to be displayed.

Thus, there is a need for a clamp assembly which, by modest hand pressure, can be easily adjusted to a wide number of positions on the suspension member of a garment hanger and, once placed in a desired position, easily secured to the suspension member by further modest hand pressure, particularly in conjunction with garment hangers which are intended to grip and hang a garment therefrom at a point well below the usual gripping point on the majority of garments. From time to time in the following description of the invention, this latter type of hanger will be referred to as a drop loop hanger.

SUMMARY OF THE INVENTION

The following described specific embodiment of the invention is a drop loop clamp assembly in which a pair of gripping jaws are carried by a hang structure which hangs the jaws from the suspension member of a garment hanger, so that the gripping jaws are not in direct contact with the suspension member, the hang structure (and thereby the gripping jams) being easily slidable along the suspension member under the impetus of modest hand applied movement pressure by a clerk or other user and yet the hang structure, when the desired position of the gripping jams with respect to the suspension member is established, can be easily locked to the suspension member by a further modest hand applied pressure of the user. The invention comprises the combination of said clamp assembly with a hang means (usually a hook) and a suspension member to form a garment hanger having the foregoing described advantages.

BRIEF DESCRIPTION OF THE DRAWING

The invention is illustrated more or less diagrammatically in the accompanying drawing in which.

DETAILED DESCRIPTION

Figures 1, 2, 3, 4:
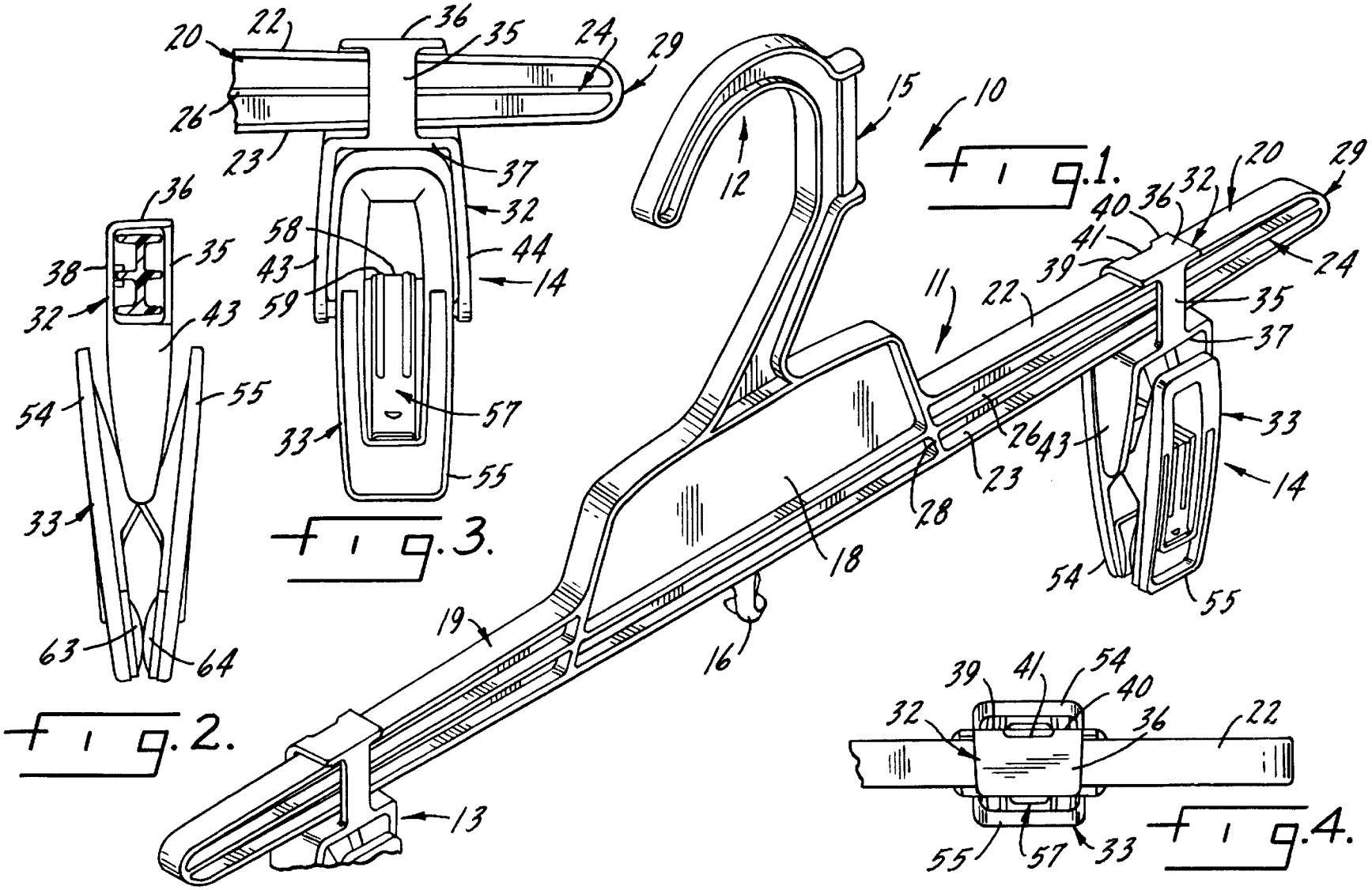
FIG. 1 is a partial perspective view of a currently preferred embodiment of the invention, here represented in the drop loop style.
FIG. 2 is a section through the suspension member at a location which shows a side view of the clamp assembly.
FIG. 3 is a front view of the drop loop clamp assembly.
FIG. 4 is a top plan view of the drop loop clamp assembly.

Like reference numerals will be used to refer to like or similar parts from Figure to Figure in the following detailed description of the invention.

A garment hanger is indicated generally at 10 in FIG. 1. The hanger includes a suspension member, indicated generally at 11, a hang means, here a hook formed integrally with the suspension member, indicated generally at 12, and left and right clamp assemblies indicated generally at 13 and 14. In this instance a size indicator is illustrated at 15 and a coordinate loop at 16, each of which is optional.

Figure 6:
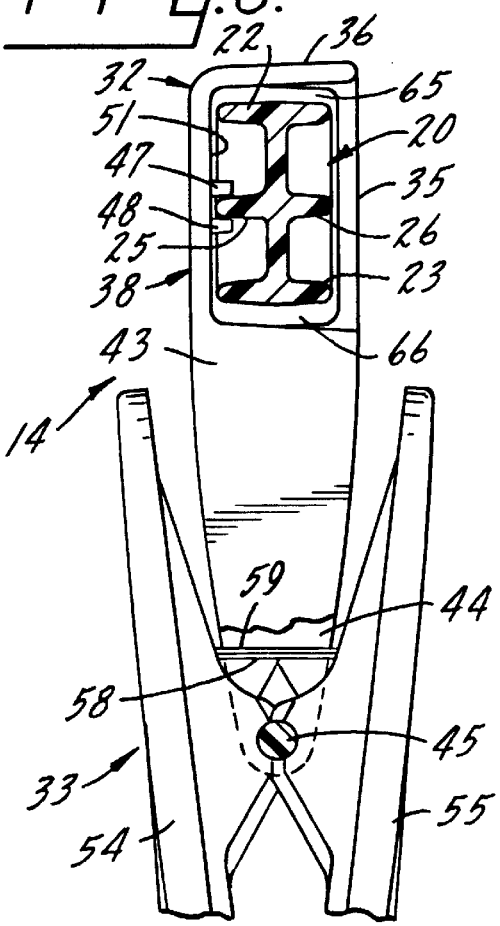
FIG. 6 is a partial section through the suspension member and clamp assembly with parts broken away.

The suspension member includes, in this instance, a central portion 18, and left arm 19 and right arm 20 which flank and extend outwardly from the central portion. Right arm 20 includes an upper flange 22, a bottom flange 23, and a central flange indicated generally at 24. From FIG. 6 it will be noted that the central flange 24 has a rear extension 25, and a front extension 26, the rear and front extensions projecting outward so as to be aligned with the upper and bottom flanges 22, 23 as is best seen in FIG. 6. An inclined wall structure 28 at the junction of the central portion 18 and the left end of right arm 20 forms an abutment which precludes movement of the right clamp assembly 14 in a left direction, and a curved end wall structure 29 forms an abutment which precludes movement of the right clamp assembly in a right direction, all as will be further described hereinafter.

Figure 5:
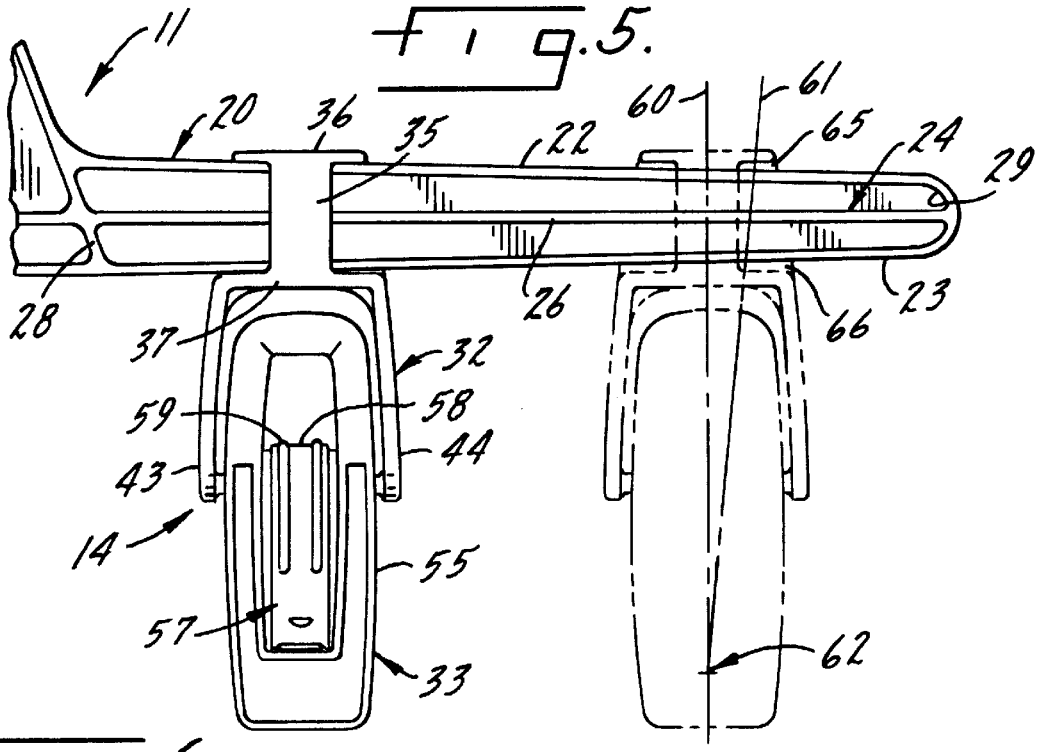
FIG. 5 is a partial front elevation of a garment hanger illustrating, in solid and phantom lines, the range of movement of the clamp assembly with respect to the suspension member.

From FIGS. 1 and, particularly, FIG. 5, it will be seen that upper and bottom flanges 22 and 23 are each inclined toward one another in an outward direction so that the vertical spacing between the central flange 24 and said upper and bottom flanges varies from point to point. Preferably the central flange 24 is horizontal when the hanger is hung from a support structure such as a garment rack in a retail outlet.

Since the clamp assemblies 13 and 14 are identical, only clamp assembly 14 need be described.

Figure 7:
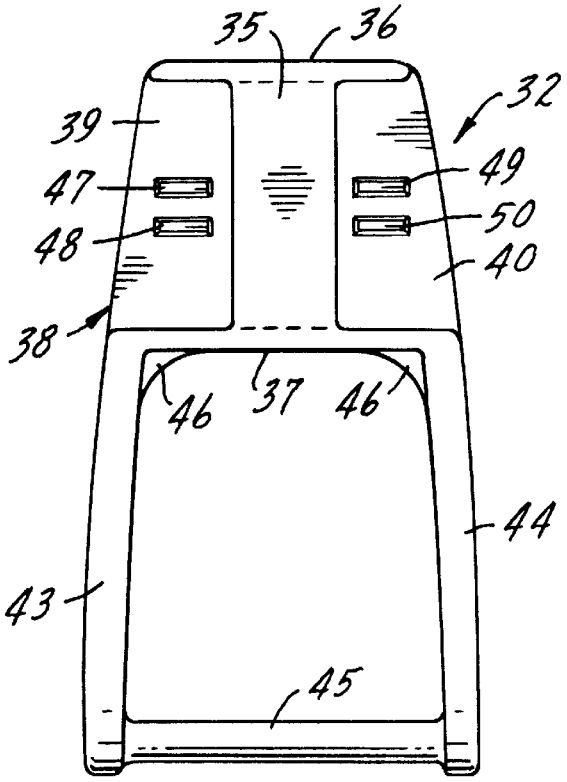
FIG. 7 is a front elevation of the hang bracket of the clamp assembly.

Clamp assembly 14 includes a drop bracket, indicated generally at 32 as shown in isolation in FIG. 7, and a garment gripping member indicated generally at 33 in several Figures. The drop bracket is preferably of a one piece construction, and while several materials are suitable, plastic is preferred. The drop bracket includes a front 35, a top 36, a bottom 37 and a rear 38, see FIG. 6.

From FIGS. 1 and 7, particularly, it will be seen that rear 38 consists of two arms or straps, 39,40 separated by a space indicated at 41, see FIG. 1. From FIG. 7 it will be seen that, in this instance, the backspace 41 is the same width as the front 35 of the drop bracket A left arm 43 and a right arm 44 extend downwardly from the edge portions of bottom 37 and are connected, at their lower end portions, by a bar or shaft 45 which functions as a pivot means as will be explained hereinafter. Strengthening fillets are indicated at 46.

Four jam guides are indicated at 47 and 48 on left arm 39 and at 49, 50 on right arm 40. Each jam guide is an inwardly extending projection, and from FIG. 6 it will be noted that the jam guides are located at the approximate mid-portion of the inner wall surface 51 of rear wall 38. Jam guides 47 and 49 are horizontally aligned with one another, and jam guides 48, 50 are also horizontally aligned with one another. The jam guides are so located as to form a slot or pathway to receive the rear extension 25 of central flange 24. A snug, yet not tight, friction fit is formed between the four jam guides and the rear extension 25. The friction fit should be tight enough so that when a user of the hanger wishes to move clamp assembly 14 either toward or away from the hang means 12, only modest hand applied pressure is necessary. At the same time, the friction fit should not be so tight as to always rigidly fix the position of the clamp assembly with respect to the suspension member when heavy garments are suspended from the hanger. The snugness of the fit will vary with the type of material used, and is within the skill of a hanger designer. The gripping member 33 includes a rear gripper 54 and a front gripper 55. Each gripper has a hemispherical recess formed at the innermost portion of its inward side, the recess being sufficient to form a journal for the shaft 45 of the drop bracket 32, see FIG. 6. An inverted generally U-shaped spring clip is indicated at 57, the upper, or bight portion of which is indicated at 58, see FIGS. 3, 5 and 6. The clip 57 has strengthening ribs formed, in this instance, in all three major surfaces of which one is indicated at 59 in FIGS. 5 and 6.

In operation, a user grasps the hanger, preferably near the central portion 18, in one hand and, with the other hand, grasps the clamp assembly 14, preferably by the drop bracket 32, and slides the clamp assembly along the rear extension 25 of the central flange 24. Since only a sliding fit is formed between the jam guides 47–50 and the rear extension 25, the clamp assembly will move relative to the balance of the hanger under modest hand pressure to a new desired location.

At the new location, which is represented by the vertical reference line 60 in FIG. 5, the user then grasps the clamp assembly, preferably with a finger above and a finger below the right arm 20, and cants or tilts the clamp assembly relative to the arm 20 until the vertical axis of the clamp assembly lies along jam line 61. The clamp assembly will pivot about an area or point indicated generally at 62 which represents the point or area of contact of the pads 63 and 64 on rear and front grippers 54, 55 respectively with a garment to be hung from the hanger.

Since the jam guides 47–50 and the rear extension 25 of the central flange 24, at least, are formed from plastic or a material having the characteristics with respect to deformability and memory of plastic, and since there is a modest friction fit between the jam guides and the rear extension 25, the contacting parts will deform slightly and a tight holding force will be generated due to the plastic deformation and the above described orientation of the plastic components. A finite clearance is difficult to specify since the characteristics of the plastic materials will vary and there will be slight variations in the degree of fit between the parts. It can be stated however that the interaction of the parts should not be so tight as to require more than the forces generated by a modest hand applied pressure to the clamp assembly to move it with respect to the suspension arm.

It will also be seen that the contour of the suspension member can vary widely without affecting the proper functioning of the system. By reference to FIGS. 1 and 6 for example it will be seen that the upper flange 22 and bottom flange 23 are at their maximum distance from the central flange 24 when the right clamp assembly is in its leftmost position. In this position the underside of the top 36 of the drop bracket is pressed against the top of the upper flange 22, and the inner surface of the bottom 37 of the drop bracket is pressed against the undersurface of bottom flange 23. By contrast, when the clamp assembly is in a far right position on suspension member 11 as represented by the phantom position of FIG. 5, there is a clear space 65 between the underside of top 36 of the drop bracket and the upper surface of upper flange 22. A similar space 66, see FIGS. 5 and 6, exists beneath bottom flange 23.

These clearances 65, 66 enable the clamp assembly to be easily tilted to the inclined position shown in FIG. 5 as represented by the jam line 61.

Although a specific example, and modifications thereof have been illustrated and described, it will at once be apparent to those skilled in the art that modifications to the basic inventive concept may be made within the spirit and scope of the invention. Hence the scope of the invention should only be limited only by the scope of the hereafter appended claims when interpreted in light of the relevant prior art, and not by the foregoing exemplary description.

What is claimed is:

1. A garment hanger comprising:

a suspension member projecting upwardly from at least one generally horizontal arm, at least one garment clamp, said clamp being carried by a suspension bracket carried by said arm, said clamp being held by said bracket beneath said arm, said clamp being pivotable within said bracket, said bracket and said clamp being movable back and forth along a portion of said garment hanger under impetus of modest hand applied force, said clamp and bracket forming a laterally movable clamp assembly, said bracket defining an opening for receiving a free end of said arm, said bracket having an upper portion which surrounds a top portion of said arm, said arm and said bracket having aligned formations which fit snugly into one another whereby said clamp assembly is held in engagement with said arm by friction of a friction fit between said aligned formations at variable positions along said arm and being movable from one position to another along said arm by modest hand-applied force sufficient to overcome said friction of said friction fit.

2. A garment hanger in accordance with claim 1 including:

a plurality of projections on the suspending means which are arranged to define a groove dimensioned to receive a complementarily contoured portion of said arm to form said friction fit, said projections being composed of a material having the characteristics with respect to deformability and memory of plastic.

3. A garment hanger in accordance with claim 1 wherein:

said bracket is a closed-loop structure which is arranged to surround said arm, and said projections are located on an inside surface of said structure.

* * * * *